US008147283B2

(12) United States Patent
Furuya et al.

(10) Patent No.: US 8,147,283 B2
(45) Date of Patent: Apr. 3, 2012

(54) STEERING APPARATUS FOR OUTBOARD MOTOR

(75) Inventors: Kentaro Furuya, Saitama (JP); Shigekazu Sakata, Saitama (JP); Hiroshi Mizuguchi, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 211 days.

(21) Appl. No.: 12/717,524

(22) Filed: Mar. 4, 2010

(65) Prior Publication Data

US 2010/0273369 A1 Oct. 28, 2010

(30) Foreign Application Priority Data

Apr. 23, 2009 (JP) ..... P2009-105341
Oct. 23, 2009 (JP) ..... P2009-244546

(51) Int. Cl.
*B63H 5/125* (2006.01)
*B63H 20/08* (2006.01)
*B63H 25/10* (2006.01)

(52) U.S. Cl. ..... 440/63; 440/53; 440/61 S; 114/144 R

(58) Field of Classification Search ..... 114/144 R; 440/63, 53, 61 S, 61 F
See application file for complete search history.

(56) References Cited

U.S. PATENT DOCUMENTS 3,613,624 A * 10/1971 Stauffer ..... 114/74 R
4,373,920 A * 2/1983 Hall et al. ..... 440/59
4,909,765 A * 3/1990 Riske et al. ..... 440/59
4,964,354 A * 10/1990 Latham ..... 114/144 R
5,236,210 A * 8/1993 Ogiso ..... 280/124.139
6,146,221 A * 11/2000 Natsume ..... 440/55
6,883,451 B2 * 4/2005 Takada et al. ..... 114/144 R
7,179,143 B2 * 2/2007 Mizuguchi et al. ..... 440/61 S

FOREIGN PATENT DOCUMENTS

JP 05-319387 A 12/1993

* cited by examiner

*Primary Examiner* — Lars A Olson
*Assistant Examiner* — Andrew Polay
(74) *Attorney, Agent, or Firm* — Arent Fox LLP

(57) ABSTRACT

A steering apparatus whereby the steering load is equal even when the left and right steering angles are large when an outboard motor is steered to the left and right via a swivel shaft. A connecting hole of a steering plate is provided at a position spaced from a center line of the steering plate so that equal angles are formed by a first straight line, joining the center of the swivel shaft and the connecting hole, and a second straight line, joining the connecting hole and a link hole formed in a steering rod.

3 Claims, 9 Drawing Sheets

STEERING APPARATUS FOR OUTBOARD MOTOR

FIELD OF THE INVENTION

The present invention relates to a steering apparatus for an outboard motor, which includes a steering plate and a steering rod.

BACKGROUND OF THE INVENTION

Among conventional outboard motors, steering apparatuses comprising a steering plate and a steering rod are known, such as the one disclosed in Japanese Patent Application Laid-Open Publication No. 5-319387 (H05-319387 A), for example. FIGS. 7 and 8 hereof show the steering apparatus disclosed in H05-319387A.

Referring to FIG. 7, in a steering apparatus 200, a steering cable 201 is moved by turning a steering handle left and right. A linking member 202 linked to the steering cable 201 then moves left and right as shown by the arrow (1), and a steering rod 203 connected to the end of the linking member 202 moves as shown by the arrow (2). The distal end of a steering plate 204 is pushed and pulled by the steering rod 203, and the steering plate 204 swings left and right about a swivel shaft 205 as shown by the arrow (3). As a result, an outboard motor body connected to a rear end part 206 of the steering plate 204 is steered, and an operator can steer the outboard motor.

A connecting hole 208 of the steering rod 203 is formed on a center line 207 of the steering plate 204 as shown in FIG. 8. The connecting hole 208 traverses an arc 209 of a radius R centered on the swivel shaft 205.

The symbol $\alpha 1$ represents the steering angle when the linking member 202 is moved in the same distance either to the left or right from a neutral position shown by the solid line and the steering plate 204 is swung far to the left or right. In this example, $\alpha 1=50°$. The center line 207 passes through the center of the swivel shaft 205. The linked portion between the linking member 202 and the steering rod 203 constitutes a linking point 210, the linked portion between the steering rod 203 and the steering plate 204 constitutes a linked point 211, and a straight line joining the connecting point 210 and the connecting point 211 is designated as a straight line 212.

The symbol $\beta 1$ represents the angle formed by the center line 207 and the straight line 212 when the steering plate 204 has swung to the left from its neutral position in a vertical state, and the symbol $\beta 2$ represents the angle formed by the center line 207 and the straight line 212 when the steering plate 204 has swung to the right.

When the outboard motor is steered, the linked point 211 bears a force F1 tangential to the arc 209 whether the outboard motor is steered to the left or right. Given that S1 represents the force of the steering rod 203 pushing on the steering plate 204 when the outboard motor is steered to the left and S2 represents the force of the steering rod 203 pulling on the steering plate 204 when the outboard motor is steered to the right, $\beta 1<\beta 2$, and therefore $S1>S2$. Specifically, the steering load is greater when steering is to the left than when steering is to the right. In other words, there is a disparity in steering loads between left steering and right steering.

SUMMARY OF THE INVENTION

It is therefore an object of the present invention to provide a steering apparatus whereby the steering load is equal for both left and right steering even in the case of a large steering angle.

According to the present invention, there is provided a steering apparatus for an outboard motor, which apparatus comprises: a swivel shaft for steerably mounting the outboard motor to a hull; a steering plate extending outwardly from a body of the outboard motor; and a steering rod for pushing and pulling the steering plate so that the steering plate turns to left and right about the swivel shaft, wherein the steering plate has a connecting hole for connecting one end of the steering rod, and the connecting hole is provided at a position set apart from a center line of the steering plate that passes over the swivel shaft, so that, when the steering plate turns a same angle to the left and right from a neutral state of not having turned to the left or right, equal left and right angles are formed by a first straight line, joining a center of the swivel shaft and the connecting hole, and a second straight line, joining the connecting hole and a link hole (33) formed in an opposite end of the steering rod.

In this arrangement, since equal left and right angles are formed by a first straight line joining the center of the swivel shaft and the connecting hole and a second straight line joining the connecting hole and a link hole formed in the other end of the steering rod, the forces whereby the steering rod is pushed and pulled are equal, and the left and right steering loads can be made equal to each other.

Preferably, an angle formed by the first straight line and the center line when the steering plate is in the neutral position is designed to increase in accordance with enlargement of a set value of a maximum steering angle of the outboard motor. It is thus possible to make the left and right steering loads equal to each other in accordance with changes in the set value of the maximum steering angle.

Desirably, the steering plate includes a small steering angle connecting hole provided on the center line at a position spaced farther away from the swivel shaft than the connecting hole, so that selection between the small steering angle connecting hole and the connecting hole is allowed for connection of the one end of the steering rod. This arrangement makes it possible to adapt to two maximum steering angle settings with a single steering plate, to reduce the cost of components, and to reduce the number of steps in component replacement operations.

BRIEF DESCRIPTION OF THE DRAWINGS

A preferred embodiment of the present invention will be described in detail below, by way of example only, with reference to the accompanying drawings, in which:

FIG. 5A is a schematic view showing, for the sake of comparison to the present embodiment, a steering load created when a connecting hole for connecting one end of the steering rod is provided on a center line of the steering plate passing over the center of the swivel shaft, while

DETAILED DESCRIPTION OF THE PREFERRED EMBODIMENT

Figure 1:
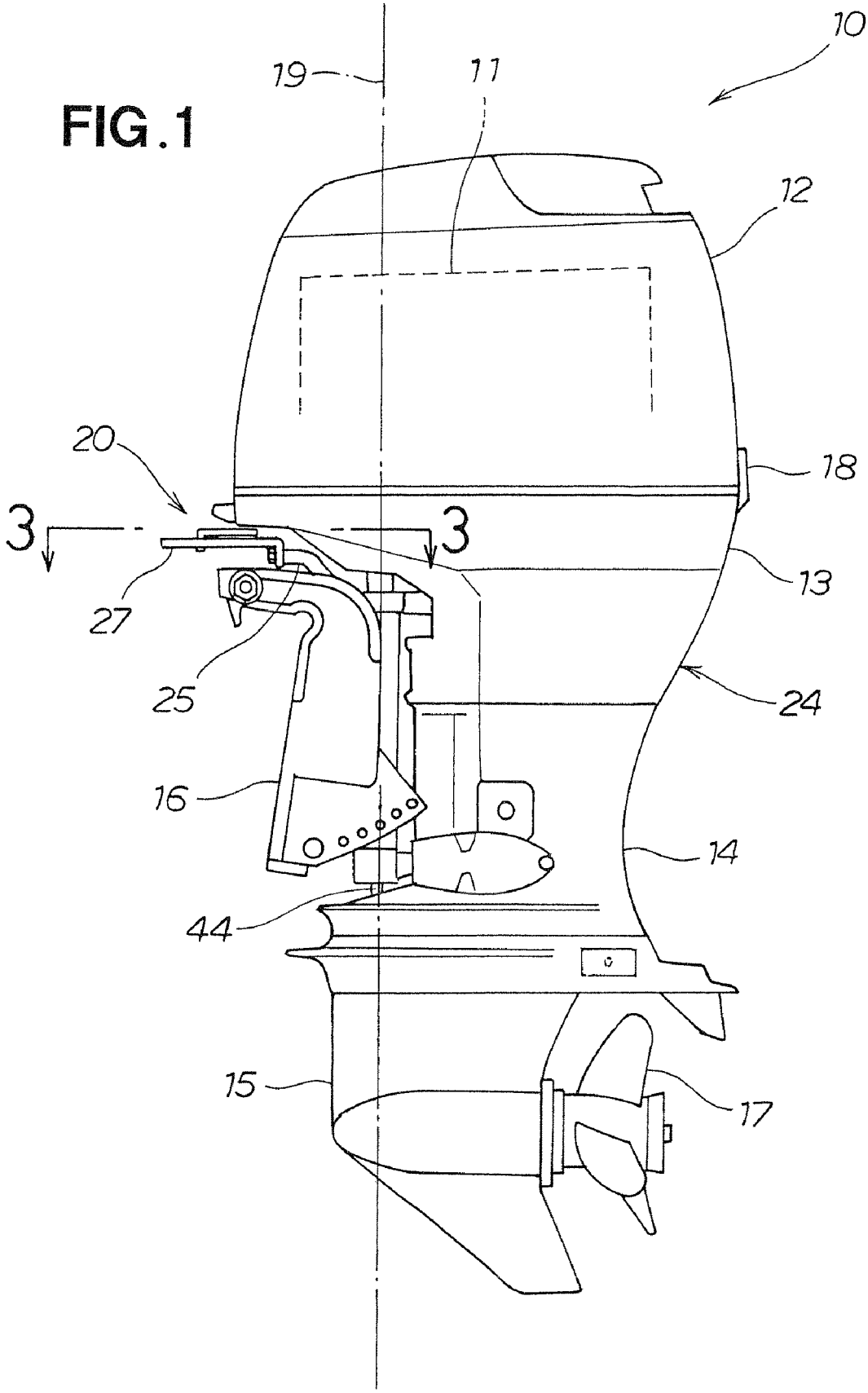
FIG. 1 is a side elevational view showing an outboard motor employing a steering apparatus according to the present invention.

According to FIG. 1, an outboard motor 10 comprises an engine 11 at the top. The engine 11 is a longitudinal engine in which the cylinders and pistons are oriented transversely and the crankshaft and camshaft are oriented longitudinally.

The outboard motor 10 includes a top engine cover 12 for covering the top of the engine 11, a bottom engine cover 13 provided underneath the engine cover 12, an extension case 14 provided underneath the engine cover 13, and a gear case 15 provided underneath the extension case 14.

A steering apparatus 20 of the outboard motor 10 is provided in front of the bottom engine cover 13. A stern bracket 16 for mounting the outboard motor 10 to the hull is provided on the front side of the bottom engine cover 13.

A propeller 17 rotated by the motive force of the engine 11 to achieve propulsion force is rotatably provided at the rear of the gear case 15. By switching with a pair of dog clutches, the propeller 17 can be switched between forward rotation and reverse rotation, and the outboard motor 10 can achieve forward and reverse propulsion force.

The top engine cover 12 engages a hook on the inside of the front of the bottom engine cover 13 and is attached by a stopper 18 in the back. The outboard motor 10 swings relative to the hull about a center line 19 of a swivel shaft 44, described hereinafter.

Next, the configuration of the steering apparatus 20 according to the present embodiment will be described based on the perspective view shown in FIG. 2.

Figure 2:
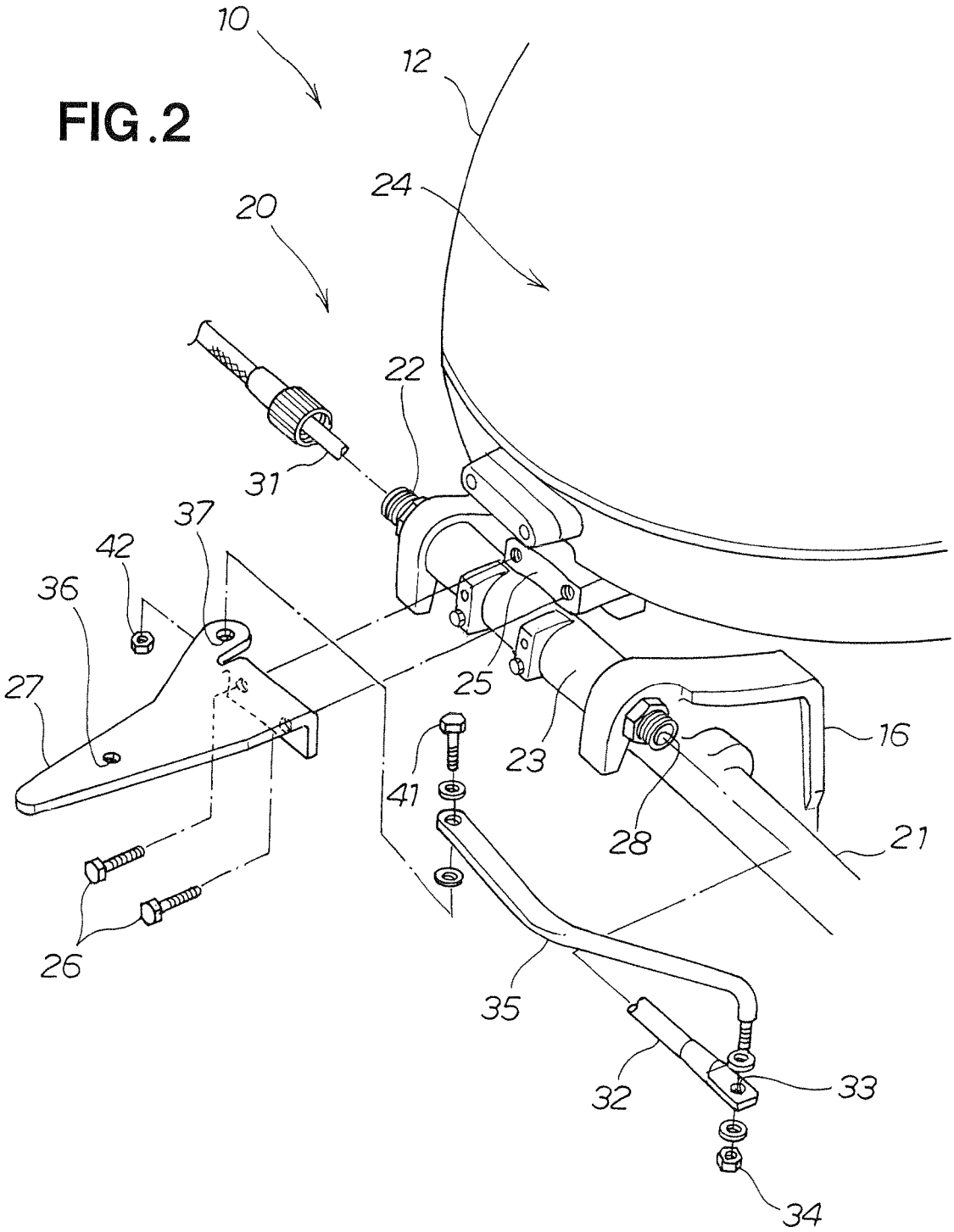
FIG. 2 is an exploded perspective view of the steering apparatus.

Referring to FIG. 2, the steering apparatus 20 of the outboard motor 10 includes a stern bracket 16, a tilting shaft 22, a swivel case 23, a mount frame 25, a steering plate 27, a steering wire 31, a connecting rod 32, a steering rod 35, a small steering angle connecting hole 36 and connecting hole 37, and a bolt 41 and nut 42.

The stern bracket 16 is mounted to a hull 21. The tilting shaft 22 is provided to the aforementioned stern bracket 16. The swivel case 23 is turnably provided to the tilting shaft 22. The mount frame 25 is turnably provided on the axis line 19 (FIG. 1) of the swivel shaft 44 (FIG. 3) and is used to hold an outboard motor body 24. The steering plate 27 is provided to the end of the mount frame 25 via a bolt 26. The steering wire 31 is led from a steering handle into a through-channel 28 of the tilting shaft 22. The connecting rod 32 is connected to the steering wire 31 and is free to slide within the through-channel 28. One end of the steering rod 35 is turnably provided via a nut 34 to a link hole 33 formed in the end of the connecting rod 32. The small steering angle connecting hole 36 and the connecting hole 37 are formed in the steering plate 27. The other end of the steering rod 35 is linked to the steering plate 27 by the bolt 41 and the nut 42 so as to be free to turn relative to the connecting hole 37.

The steering rod 35 may be turnably connected to the small steering angle connecting hole 36. The connecting rod 32 may be connected to the steering wire 31 via a hydraulic cylinder.

In the present embodiment, a steering plate provided with the connecting hole 37 and the small steering angle connecting hole 36 was described, but a steering plate 27 provided with only the connecting hole 37 may also be used.

Figure 3:
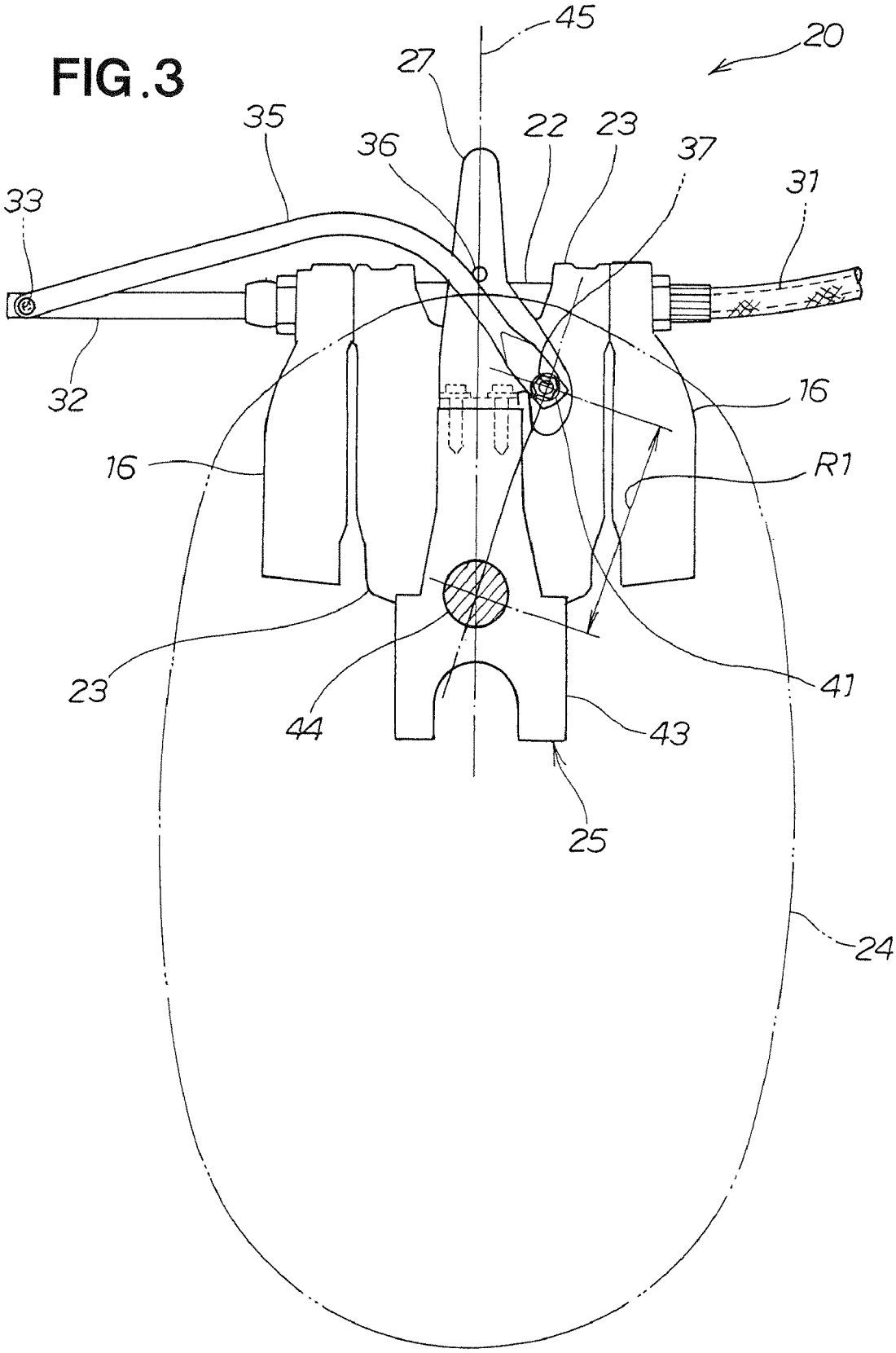
FIG. 3 is an enlarged cross-sectional view taken along line 3-3 of FIG. 1.

According to FIG. 3, the mount frame 25 is composed of a mount part 43 connected to the steering plate 27 and the outboard motor body 24, and the swivel shaft 44 which is turnably provided to the swivel case 23. The axis line 19 shown in FIG. 1 passes through the center of the swivel shaft 44.

A center line 45 of the steering plate 27 passes through the center of the swivel shaft 44. The small steering angle connecting hole 36 is provided on the center line 45 of the steering plate 27.

The connecting hole 37 is provided to a position nearer to the swivel shaft 44 than the small steering angle connecting hole 36 and farther from the center line 45 of the steering plate 27. The connecting hole 37 is provided so that the steering load is equal regardless of whether the steering plate 27 swings to the left or right.

Figure 8:
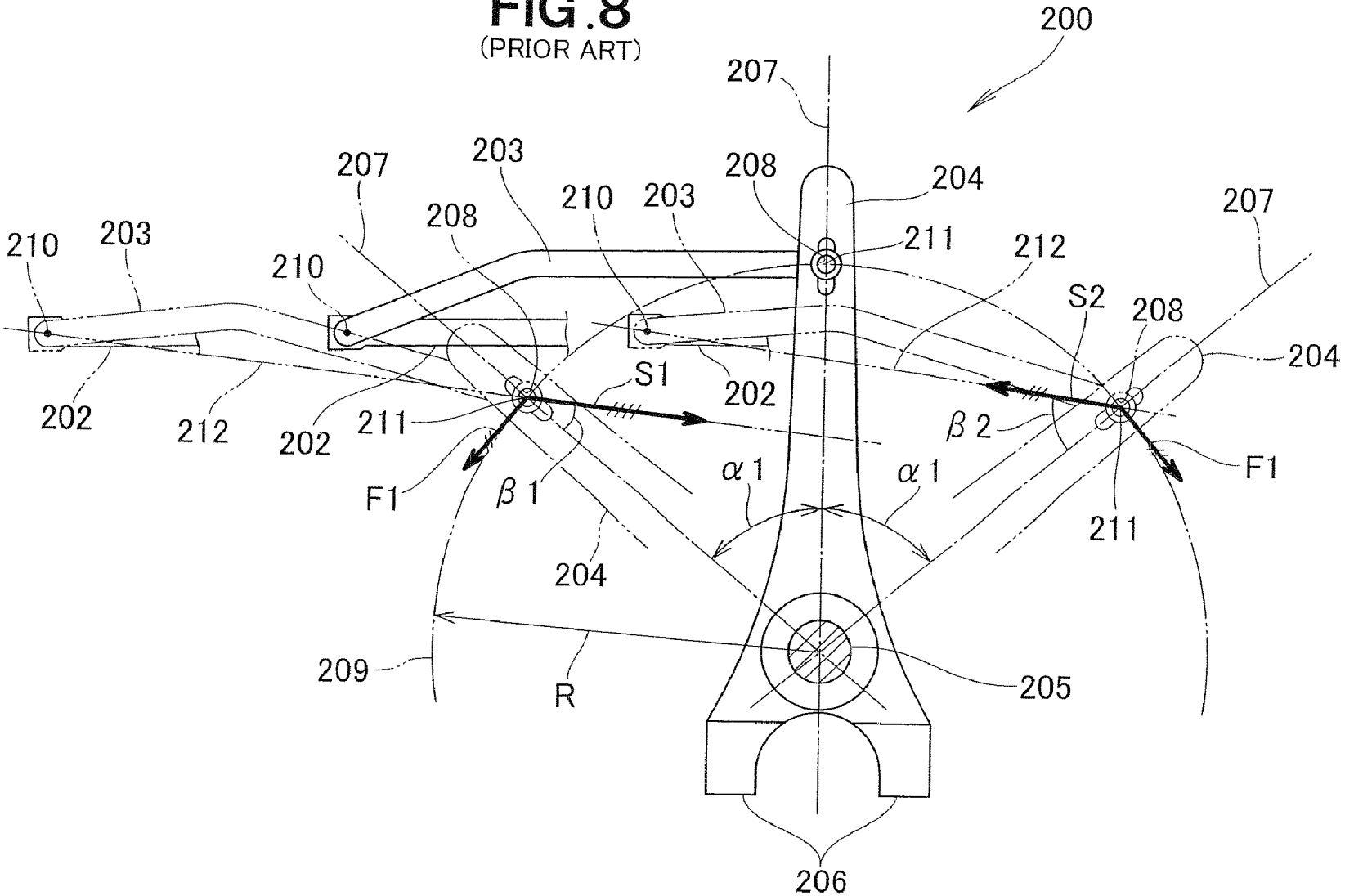
FIG.8 (PRIOR ART)
FIG. 8 is a schematic view showing steering loads created by the conventional steering apparatus of FIG. 7.

In the conventional art shown in FIG. 8, the maximum value of the steering angle of the outboard motor can sometimes change. According to FIG. 8, the maximum value of the steering angle has only one setting, and in order to change the setting of the maximum value of the steering angle, both the steering plate 204 and the steering rod 203 must be replaced together as one set. In other words, both the steering plate 204 and the steering rod 203 must be prepared separately as one set every time the value of the steering angle is set, which increases component costs as well as the number of steps in component replacement. Therefore, there is a demand for a steering apparatus of an outboard motor whereby the setting of the steering angle can be changed without separately preparing closed stock of a steering plate and a steering rod.

In view of this, the present invention has a configuration in which the steering plate 27 also has a small steering angle connecting hole 36 on the center line 45 in a position farther from the swivel shaft 44 than the connecting hole 37 as shown in FIG. 3, whereby either the small steering angle connecting hole 36 or the connecting hole 37 can be selected to connect the distal end of the steering rod 35. It is thereby possible to adapt to two maximum steering angle settings with a single steering plate 27, to reduce component costs, and to reduce the number of steps in component replacement operations.

With R1 representing the distance from the center of the swivel shaft 44 to the center of the connecting hole 37, the connecting hole 37 moves along an arc of radius R1 centered on the center of the swivel shaft 44. Steering is achieved by the distal end of the steering plate 27 being pushed and pulled by the steering rod 35. When the steering rod 35 is connected to the connecting hole 37, the maximum value of the steering angle is 50°.

Next, the action of the steering apparatus 20 described above will be described based on FIGS. 4A to 4C.

Figure 4A:
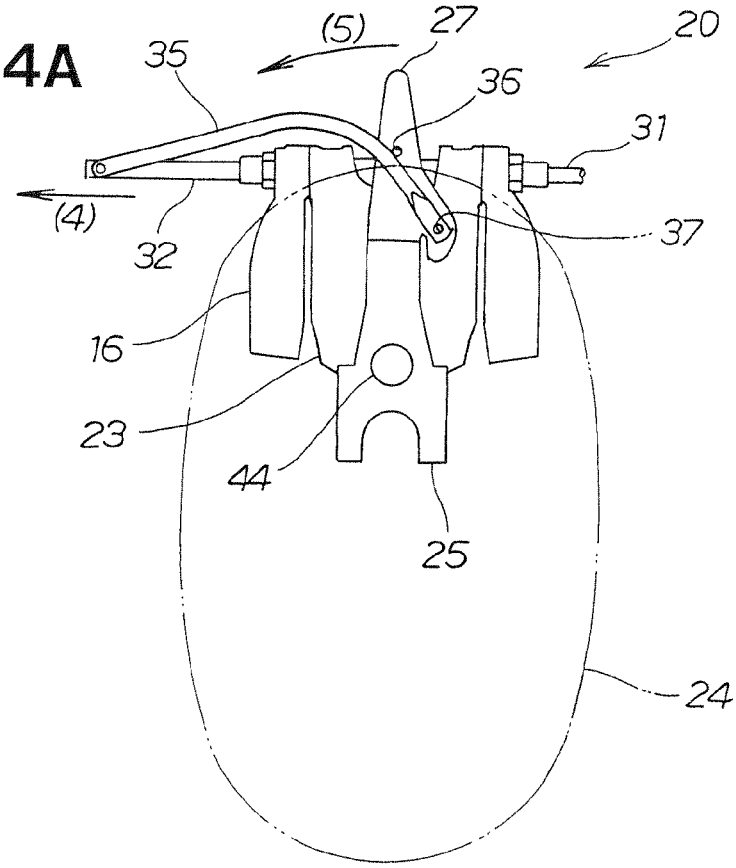
FIGS. 4A through 4C are schematic views illustrating an action of the steering apparatus when the outboard motor is steered to the left and right.

The steering rod 35 is connected to the connecting hole 37 as shown in FIG. 4A. When the steering handle is turned to the right, the steering rod 35 moves in the direction shown by the arrow (4). The distal end of the steering plate 27 is pulled, and the steering plate 27 turns about the swivel shaft 44 in the direction shown by the arrow (5). As a result, the hull is steered to the right as shown in FIG. 4B.

Figure 4B:
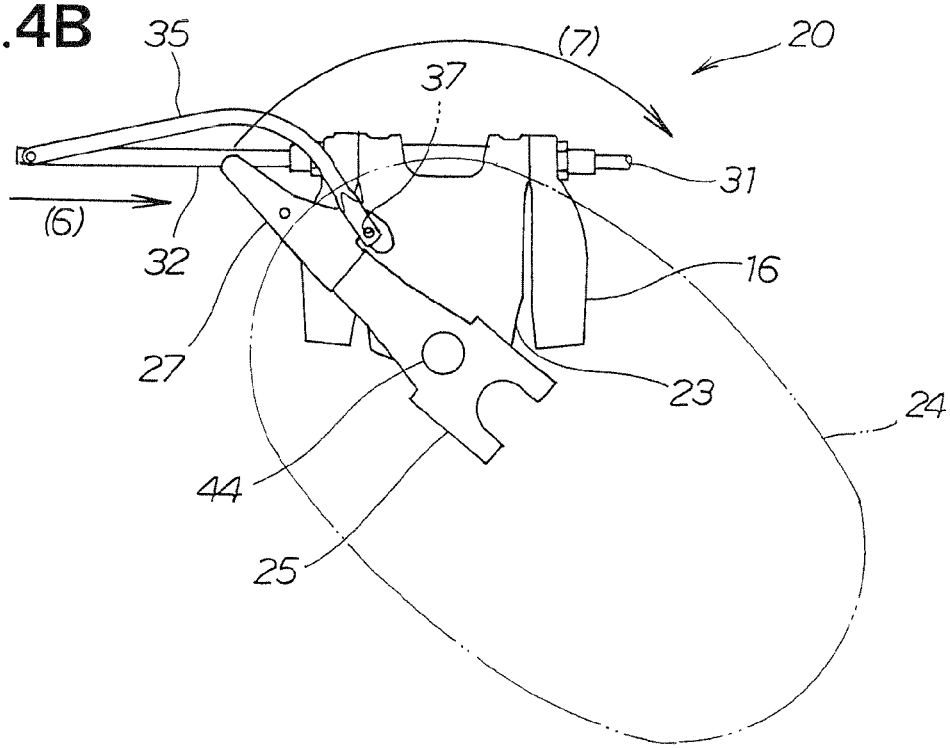
Figure 4C:
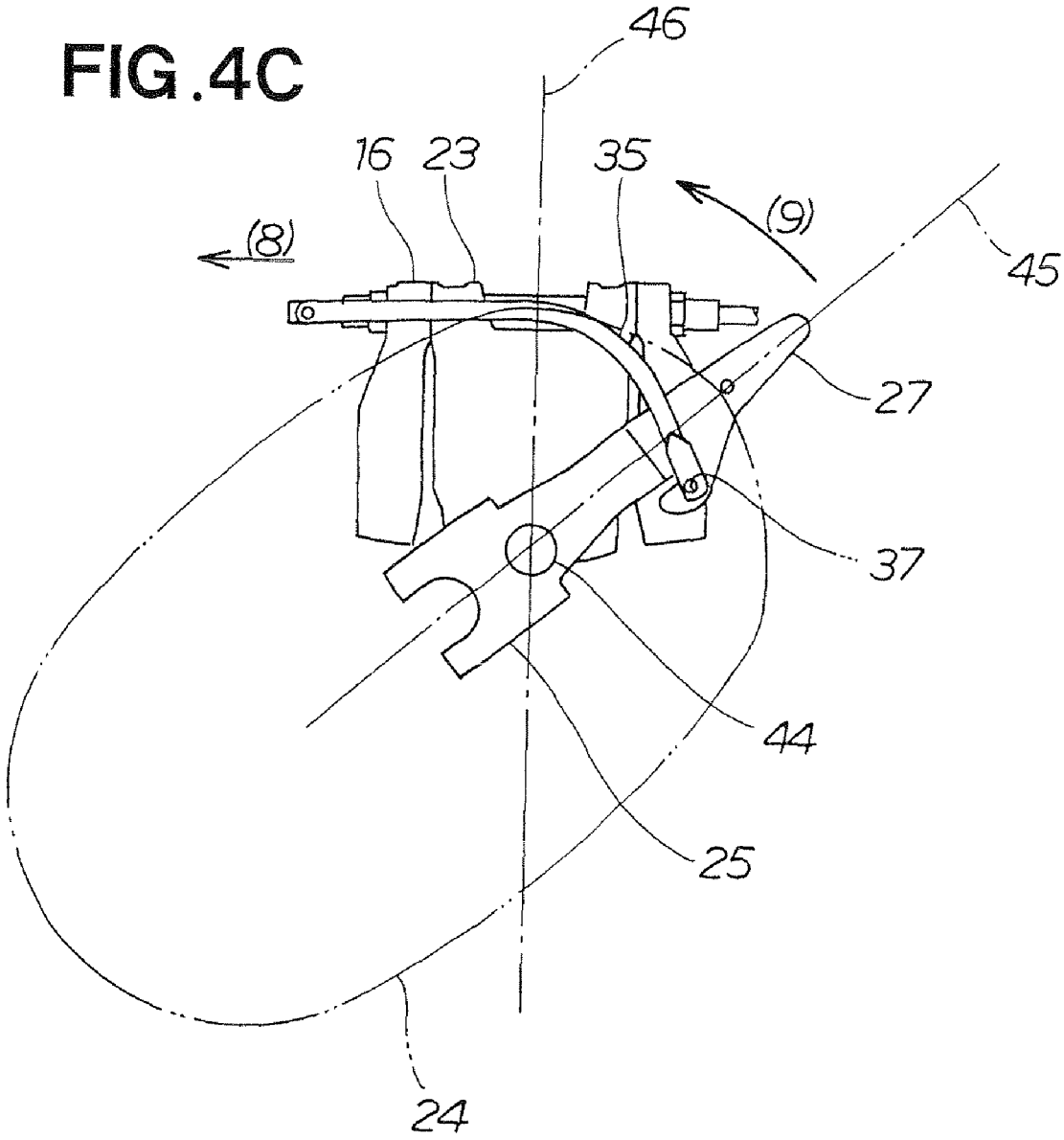

When the steering handle is turned to the left, the steering rod 35 moves in the direction shown by the arrow (6) as shown in FIG. 4B. The distal end of the steering plate 27 is pushed, and the steering plate 27 turns about the swivel shaft 44 in the direction shown by the arrow (7). As a result, the hull is steered to the left as shown in FIG. 4C.

In order to propel the hull forward, the steering handle is again turned to the right, and the steering rod 35 is moved in the direction shown by the arrow (8). The steering plate 27 is turned about the center of the swivel shaft 44 in the direction shown by the arrow (9), and the center line 45 of the steering plate is made to coincide with an axis line 46 of the forward direction, whereupon the steering handle is stopped. The same applies to cases in which the steering plate 27 is provided with only one connecting hole 37.

Next, the steering load will be described based on FIGS. 5A and 5B.

Figure 5A:
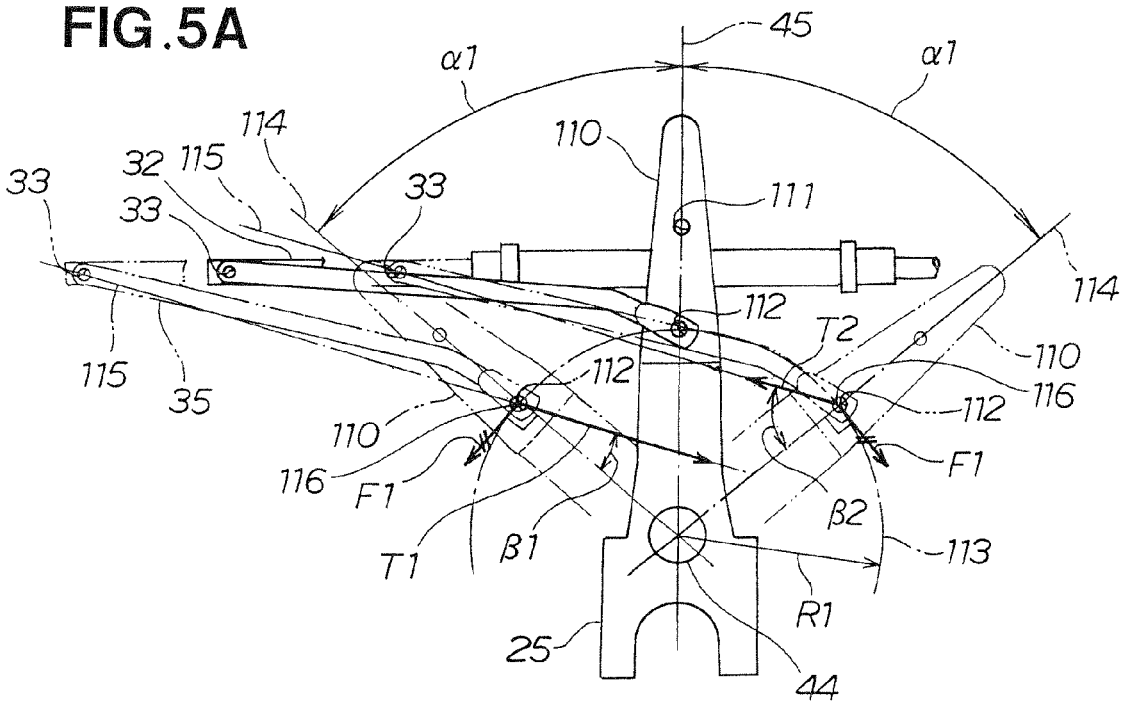

FIG. 5A shows a comparative example, in which a small steering angle connecting hole 111 and a connecting hole 112 are provided on the center line 45 of a steering plate 110. The distance from the center of the swivel shaft 44 to the connecting hole 112 is represented as R1. The connecting hole 112 moves along an arc 113 of radius R1 centered on the center of the swivel shaft 44.

The symbol $\alpha 1$ represents the steering angle when the connecting rod 32 is moved the same distance to the left or right from the neutral position and the steering plate 110 turns to the left or right about the swivel shaft 44 from the neutral position (the center line 45), wherein $\alpha 1=50°$. The straight line joining the center of the swivel shaft 44 and the center of the connecting hole 112 is designated as a straight line 114, and the straight line joining the center of the connecting hole 112 and the center of the link hole 33 is designated as a straight line 115.

Furthermore, the symbol $\beta 1$ represents the angle formed by the straight line 114 and the straight line 115 when the steering plate 110 swings to the left from the neutral position, and the symbol $\beta 2$ represents the angle formed by the straight line 114 and the straight line 115 when the steering plate 110 swings to the right.

When the outboard motor is steered, a point 116 linking the connecting hole 112 of the steering plate 110 and the steering rod 35 bears a force F1 tangential to the arc 113 whether the outboard motor is steered to the right or to the left. The symbol T1 represents the force of the steering rod 35 pushing on the steering plate 110 when the outboard motor is steered to the left, and the symbol T2 represents the force of the steering rod 35 pulling on the steering plate 110 when the outboard motor is steered to the right. $\beta<\beta 2$, and therefore T1>T2. Specifically, the steering loads are not equal between left steering and right steering. The steering load during left steering is greater than during right steering.

Figure 5B:
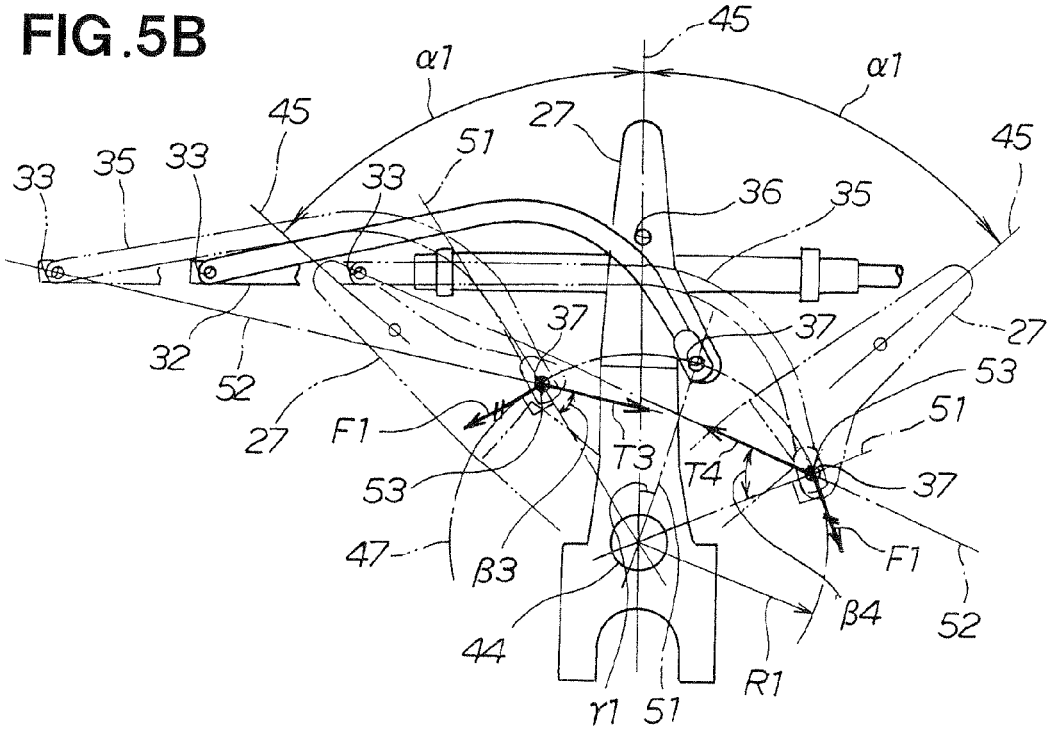
FIG. 5B is a schematic view showing the steering load created in the present embodiment.

FIG. 5B shows the steering apparatus according to the present embodiment. The connecting hole 37 of the steering plate 27 is provided to a position nearer to the swivel shaft 44 and the small steering angle connecting hole 36 and farther from the center line 45 of the steering plate 27. The distance from the center of the swivel shaft 44 to the connecting hole 37 is represented as R1. The connecting hole 37 moves through a path along an arc 47 of radius R1 centered on the center of the swivel shaft 44.

The symbol $\alpha 1$ represents the steering angle when the connecting rod 32 is moved the same distance either left or right from the neutral position and the steering plate 27 swings to the left or right from the neutral position, wherein $\alpha 1=50°$. A straight line joining the center of the swivel shaft 44 and the center of the connecting hole 37 is designated as a first straight line 51, and a straight line joining the center of the connecting hole 37 and the center of the link hole 33 is designated as a second straight line 52. The symbol $\beta 3$ represents the angle formed by the first straight line 51 and the second straight line 52 when the steering plate 27 swings to the left, and the symbol $\beta 4$ represents the angle formed by the first straight line 51 and the second straight line 52 when the steering plate 27 swings to the right.

When the outboard motor is steered, a point 53 linking the connecting hole 37 of the steering plate 27 and the steering rod 35 bears a force F1 tangential to the arc 47 whether the outboard motor is steered to the right or to the left. The symbol T3 represents the force of the steering rod 35 pushing on the steering plate 27 when the outboard motor is steered to the left, and the symbol T4 represents the force of the steering rod 35 pulling on the steering plate 27 when the outboard motor is steered to the right. $\beta 3=\beta 4$, and therefore T3>T4. Specifically, the steering loads are equal between left steering and right steering. Furthermore, since T2<T4, it is possible to improve the steering load.

Thus, even in the case of a large steering angle, the steering load during left steering can be prevented from being greater than right steering. In other words, the steering loads can be made to be equal for both left and right steering.

When the steering plate 27 is in the neutral position, the angle $\gamma 1$ formed by the first straight line 51 and the center line 45 passing through the swivel shaft 44 is designed so as to increase according to the size of the set value of the maximum steering angle of the outboard motor 10. It is thereby possible to equalize the left and right steering loads in accordance with changes in the set value of the maximum steering angle.

Furthermore, even in the case of a steering plate 27 provided with the connecting hole 37 alone, the angle $\gamma 1$ is similarly designed so as to increase according to the size of the set value of the maximum steering angle of the outboard motor 10, and it is possible to equalize the left and right steering loads in accordance with changes in the set value of the maximum steering angle.

Next, the manner in which the steering rod 35 is connected to the small steering angle connecting hole 36 will be described based on FIG. 6. The components configured from the same members in FIG. 4 are denoted by the same numerical symbols and are not described in detail herein.

Figure 6:
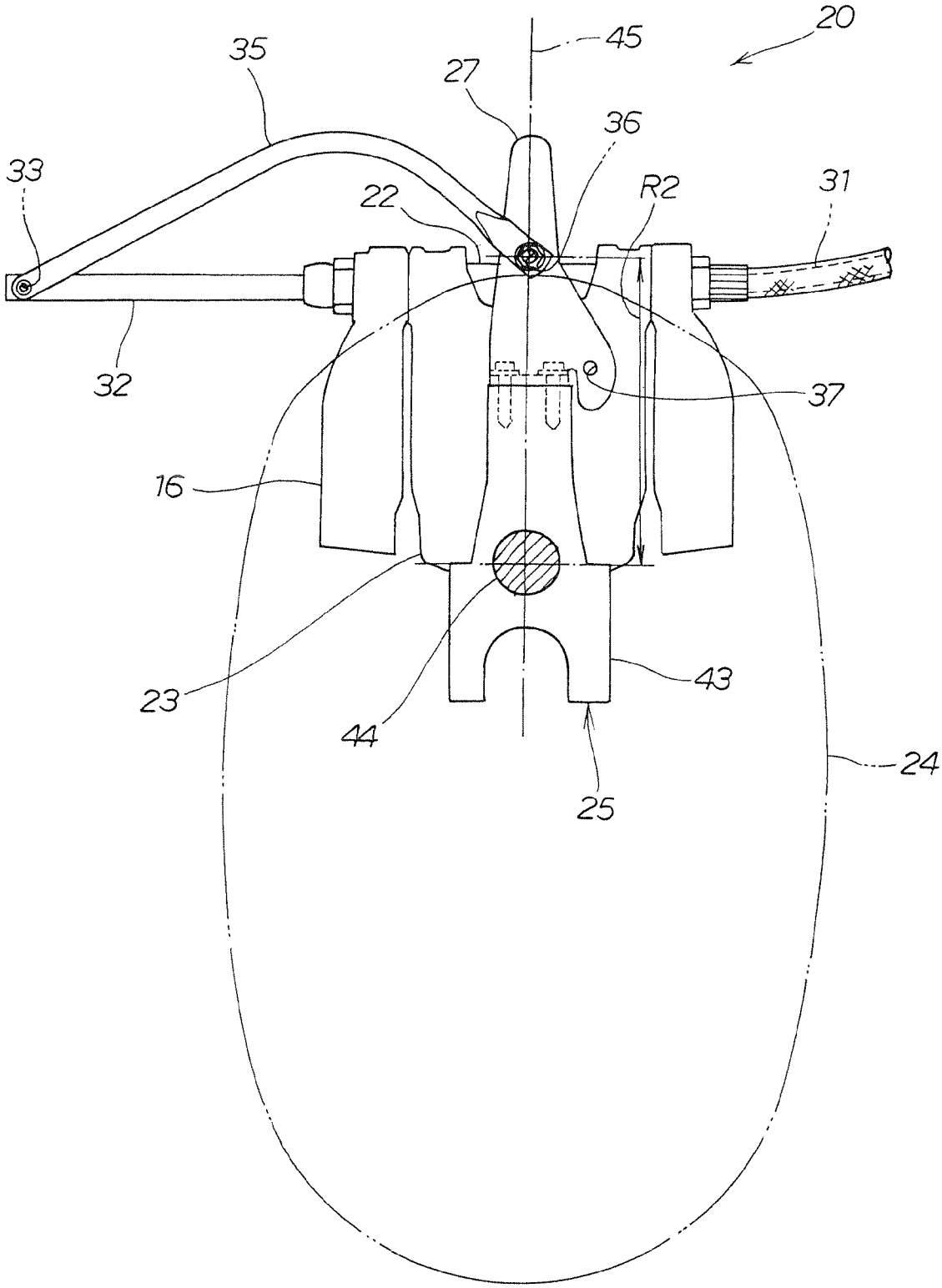
FIG. 6 is a schematic view showing a manner in which the steering rod of FIG. 3 is connected to a small steering angle connecting hole.
Figure 7:
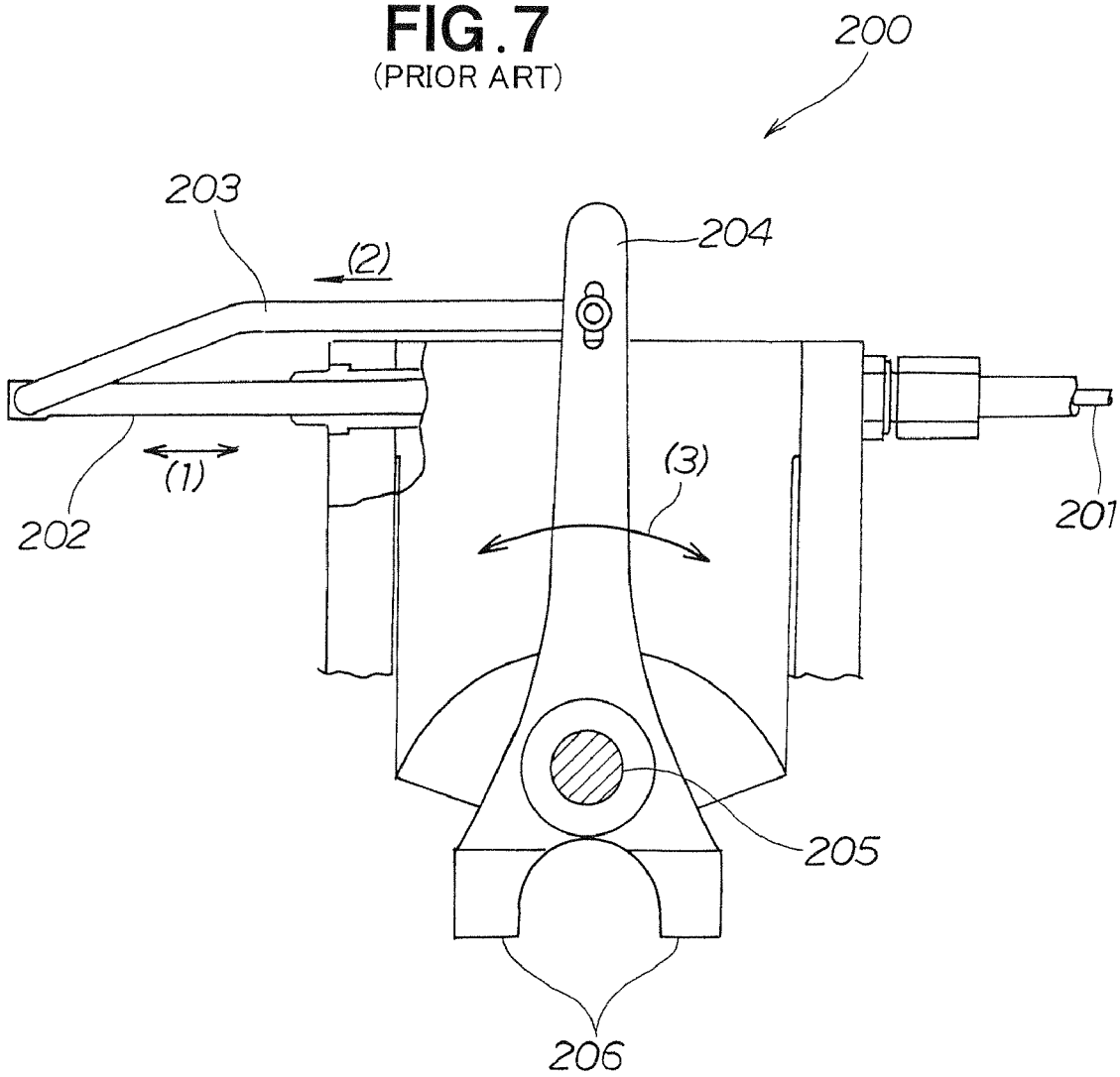
FIG. 7 (PRIOR ART)
FIG. 7 is a schematic view showing a conventional steering apparatus.

The small steering angle connecting hole 36 is provided on the center line 45 of the steering plate 27, as shown in FIG. 6.

With the symbol R2 representing the distance from the center of the swivel shaft 44 to the center of the small steering angle connecting hole 36, the small steering angle connecting hole 36 moves along an arc of radius R2 centered on the center of the swivel shaft 44. Steering is achieved by the distal end of the steering plate 27 being pushed and pulled by the steering rod 35. When the steering rod 35 is connected to the small steering angle connecting hole 36, the maximum value of the steering angle is 30°.

The radius R2 connecting the steering rod 35 to the small steering angle connecting hole is designed to be greater than the radius R1 connecting the steering rod 35 to the connecting hole 37, and the circumferential force components are designed to be substantially equal to the left and right when the steering plate 27 is swung 30° to the left and right, as shown in FIG. 3. As a result, there is no substantial difference in steering loads between left and right steering.

The steering apparatus according to the present invention was applied to cases in which the maximum values of the steering angles were 30° and 50° in the present embodiment, but can also be applied to cases of 40°, 45°, and 55°, and other steering angle maximum values may be set by opening a plurality of connecting holes in the steering plate as long as a plurality of steering angle maximum values is set in a single steering plate.

Obviously, various minor changes and modifications of the present invention are possible in light of the above teaching. It is therefore to be understood that within the scope of the appended claims the invention may be practiced otherwise than as specifically described.

What is claimed is:

1. A steering apparatus for an outboard motor, comprising:

a swivel shaft for steerably mounting the outboard motor to a hull;

a steering plate extending outwardly from a body of the outboard motor; and a steering rod for pushing and pulling the steering plate so that the steering plate turns to left and right about the swivel shaft, wherein the steering plate has a connecting hole for connecting one end of the steering rod, and the connecting hole is provided at a position set apart from a center line of the steering plate that passes over the swivel shaft, so that, when the steering plate turns a same angle to the left and right from a neutral state of not having turned to the left or right, equal left and right angles are formed by a first straight line, joining a center of the swivel shaft and the connecting hole, and a second straight line, joining the connecting hole and a link hole formed in an opposite end of the steering rod.

2. The steering apparatus of claim 1, wherein an angle formed by the first straight line and the center line when the steering plate is in the neutral position is designed to increase in accordance with enlargement of a set value of a maximum steering angle of the outboard motor.

3. The steering apparatus of claim 1, wherein the steering plate includes a small steering angle connecting hole provided on the center line at a position spaced farther away from the swivel shaft than the connecting hole, so that selection between the small steering angle connecting hole and the connecting hole is allowed for connection of the one end of the steering rod.

* * * * *